US009905958B2

(12) United States Patent
Giefers

(10) Patent No.: US 9,905,958 B2
(45) Date of Patent: Feb. 27, 2018

(54) INSULATING HOUSING OF AN ELECTRICAL TERMINAL DEVICE

(71) Applicant: PHOENIX CONTACT GMBH & CO. KG, Blomberg (DE)

(72) Inventor: Stefan Giefers, Detmold (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 15/303,024

(22) PCT Filed: Apr. 14, 2015

(86) PCT No.: PCT/EP2015/058030
§ 371 (c)(1),
(2) Date: Oct. 10, 2016

(87) PCT Pub. No.: WO2015/158691
PCT Pub. Date: Oct. 22, 2015

(65) Prior Publication Data

US 2017/0033491 A1 Feb. 2, 2017

(30) Foreign Application Priority Data

Apr. 15, 2014 (DE) ..... 10 2014 105 386

(51) Int. Cl.
*H01R 9/22* (2006.01)
*H01R 13/514* (2006.01)
*H01R 9/26* (2006.01)

(52) U.S. Cl.
CPC ..... *H01R 13/514* (2013.01); *H01R 9/2608* (2013.01)

(58) Field of Classification Search
CPC ..... H01R 13/514; H01R 9/2608
(Continued)

(56) References Cited

U.S. PATENT DOCUMENTS 6,068,522 A * 5/2000 Aoyama ..... H01R 13/514 439/701
6,080,011 A 6/2000 Tsao et al.
(Continued)

FOREIGN PATENT DOCUMENTS

DE 10037457 A1 3/2001
DE 10100081 A1 7/2002
(Continued)

*Primary Examiner* — Abdullah Riyami
*Assistant Examiner* — Nader Alhawamdeh
(74) *Attorney, Agent, or Firm* — Leydig, Voit & Mayer, Ltd.

(57) ABSTRACT

An insulating housing of an electrical terminal device includes a latching pin arranged on a front side of the housing and that protrudes therefrom in a direction perpendicular to a plane of the front side of the housing, the latching pin engaging in a latching hole arranged on a rear side of the housing in a direction perpendicular to a plane of the rear side of the housing, and a latching hook that protrudes from the front side of the housing and that engages in and latches behind a catch arranged on the rear side of the housing. The latching pin and the latching hole are in the shape of a truncated cone. A plurality of the insulating housings is capable of being plugged on top of one another to form an electrical terminal block.

11 Claims, 4 Drawing Sheets

(58) Field of Classification Search
USPC ..... 439/717
See application file for complete search history.

(56) References Cited

U.S. PATENT DOCUMENTS

| | | | | |
|---|---|---|---|---|
| 6,109,961 | A | 8/2000 | Chen et al. | |
| 6,332,813 | B1 | 12/2001 | Okabe et al. | |
| 6,336,831 | B1 | 1/2002 | Abe | |
| 7,731,547 | B2 * | 6/2010 | Giefers | H01R 13/514 439/701 |
| 2007/0249228 | A1 * | 10/2007 | Hoemann | H01R 13/7032 439/607.01 |
| 2009/0035997 | A1 | 2/2009 | Correll | |
| 2015/0147909 | A1 | 5/2015 | Gebhardt et al. | |
| 2017/0033491 | A1 * | 2/2017 | Giefers | H01R 9/2608 |

FOREIGN PATENT DOCUMENTS

| | | | |
|---|---|---|---|
| DE | 10330631 | B4 | 1/2007 |
| DE | 102007033942 | A1 | 1/2009 |
| DE | 202013104467 | U1 | 10/2013 |
| DE | 102012011676 | A1 | 11/2013 |
| EP | 1848071 | A2 | 10/2007 |
| FR | 2534420 | A1 | 4/1984 |

* cited by examiner

INSULATING HOUSING OF AN ELECTRICAL TERMINAL DEVICE

CROSS-REFERENCE TO PRIOR APPLICATIONS

This application is a U.S. National Phase application under 35 U.S.C. § 371 of International Application No. PCT/EP2015/058030, filed on Apr. 14, 2015, and claims benefit to German Patent Application No. DE 10 2014 105 386.9, filed on Apr. 15, 2014. The International Application was published in German on Oct. 22, 2015 as WO 2015/158691 A1 under PCT Article 21(2).

FIELD

The invention relates to an insulating housing of an electrical terminal device, it being possible for a plurality of insulating housings to be plugged on top of one another in order to form an electrical terminal block.

BACKGROUND

In principle, electrical terminal connector housings are known that can be arranged side-by-side in order to form an electrical terminal block. For this purpose, each housing generally comprises a centering pin on the front side and a centering opening on the rear side. When the housings are arranged side-by-side, the respective centering pins of the front side engage in the respective centering openings on the rear side of the adjacent housing. In addition, the housings are interconnected by means of a latching element. The centering pin and the centering opening thus securely position the housings side-by-side, and the latching element holds together the housings arranged side-by-side.

Housings of this kind have the disadvantage that the housings are held together only by the latching element, and the latching element generally has a certain amount of clearance when in the latched state. Thus, depending on the influence on the housings arranged side-by-side, a gap that is the size of the clearance of the latching element may be formed between the housings.

SUMMARY

In an embodiment, the present invention provides an insulating housing of an electrical terminal device, a plurality of the insulating housing being capable of being plugged on top of one another to form an electrical terminal block, the insulating housing comprising: a latching pin arranged on a front side of the housing and that protrudes therefrom in a direction perpendicular to a plane of the front side of the housing, the latching pin configured to engage in a latching hole arranged on a rear side of the housing in a direction perpendicular to a plane of the rear side of the housing; and a latching hook that protrudes from the front side of the housing and is configured to engage in and latch behind a catch arranged on the rear side of the housing, wherein the latching pin and the latching hole have a shape of a truncated cone, a diameter of the latching pin increases from the front side of the housing towards an end of the latching pin, and a diameter of the latching hole increases from the rear side of the housing towards a base of the latching hole.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
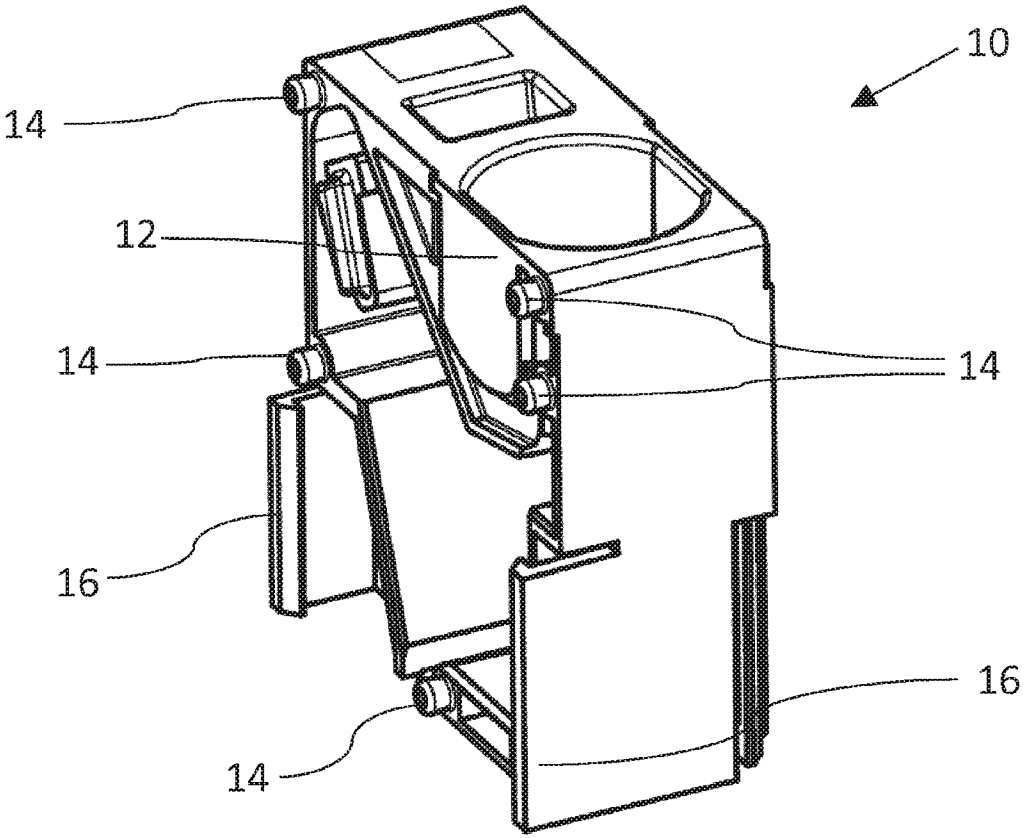
FIG. 1 is a three-dimensional view of an insulating housing from the front side of the housing, according to a preferred embodiment of the invention.

According to the invention, an insulating housing of an electrical terminal device is thus provided, it being possible for a plurality of insulating housings to be plugged on top of one another in order to form an electrical terminal block since each insulating housing comprises a latching pin that is arranged on the front side of the housing and protrudes therefrom in a direction perpendicular to the plane of the front side of the housing, the latching pin engaging in a latching hole arranged on the rear side of the housing in a direction perpendicular to the plane of the rear side of the housing, and a latching hook that protrudes from the front side of the housing and engages in and latches behind a catch arranged on the rear side of the housing, characterized in that the latching pin and the latching hole are formed in the shape of a truncated cone, the diameter of the latching pin increasing from the front side of the housing towards the end of the latching pin, and the diameter of the latching hole increasing from the rear side of the housing towards the base of the latching hole.

It is therefore an aspect of the invention that the latching pin and the latching hole are formed in the shape of a truncated cone, i.e. are conical, the diameter of the latching pin increasing from the front side of the housing towards the end of the latching pin, and the diameter of the latching hole increasing from the rear side of the housing towards the base of the latching hole. In this way, when the insulating housings are plugged on top of one another in order to form an electrical terminal block, the insulating housings are interconnected in an interlocking manner both by means of the latching hook and the catch, and by means of the latching pin and the latching hole.

In addition, when the insulating housings that are plugged on top of one another are pulled apart, the truncated cone-shaped design of the latching pin and of the latching hole generates a restoring force in a direction perpendicular to the plane of the front side of the housing and of the rear side of the housing, respectively, which force pulls the insulating housings together. A virtually clearance-free fit of the insulating housings plugged on top of one another, and a rigid interconnection of the insulating housings can thereby be achieved.

A further preferred development of the invention consists in the lateral surface of the latching pin resting against the entire surface of the inner surface of the latching hole when the insulating housings are plugged on top of one another. The restoring force generated when the insulating housings are pulled apart, and also the virtually clearance-free fit of the insulating housings to one another, can thereby be increased.

A further preferred development provides that the latching pin and the latching hole have a cone angle of between $1° \leq \alpha \leq 45°$, preferably between $1° \leq \alpha \leq 20°$. A small cone angle of between $1° \leq \alpha \leq 20°$ is preferably suitable for rigid and low-deformation latching pins, a latching pin having a cone angle of between $20° \leq \alpha \leq 45°$ preferably being used for more flexible latching pins. A cone angle of between $1° \leq \alpha \leq 45°$ is thus suitable, depending on the selected cone angle, for both low-deformation and for more flexible latching pins.

The deformability of the latching pin is important for engaging the latching pin in the latching hole opening when assembling the insulating housings or when plugging said housings on top of one another in order to form a terminal block. Therefore, a preferred development of the invention provides for the latching pin to comprise a recess at the end of the latching pin. The recess is preferably an incision in a direction perpendicular to the axis of the latching pin. The latching pin can thus be compressed in a direction perpendicular to the axis, as a result of which the cross section of the end of the latching pin can be tapered in order for the latching pin to be inserted into the latching opening. However, it is particularly preferably provided for the recess to be a recess that is conical in the axial direction of the latching pin. In this way, the latching pin is provided with a wall, the end of the latching pin being deformable in order to be inserted in the latching hole opening.

In addition, the deformability of the latching pin is preferably dependent on the depth of the recess. Therefore, a further preferred development of the invention provides for the recess to have a depth in the longitudinal direction of the latching pin that corresponds to between $50\% \leq l \leq 100\%$ of a length of the latching pin, preferably corresponding to between $50\% \leq l < 80\%$ of a length of the latching pin. A depth of the recess that is preferably 100% of the length of the latching pin results in high deformability of the latching pin, which can be advantageous when assembling the insulating housings. However, high deformability of the latching pin also reduces the restoring force that is generated by the latching pin when the insulating housings are pulled apart.

When the depth of the recess corresponds to between $50\% \leq l \leq 80\%$ of a length of the latching pin, it is possible to achieve sufficiently high deformability of the latching pin in order to assemble the insulating housings while maintaining sufficiently high rigidity of the latching pin in order to generate a corresponding restoring force when the insulating housings are pulled apart. In addition, compared with a recess over the entire depth of the latching pin, when the recess has a depth that corresponds to between $50\% \leq l \leq 80\%$ of a length of the latching pin, a latching pin base is formed on the latching pin in the region of the connection to the front side of the housing, which base can make the connection of the latching pin to the front side of the housing very stable.

In order to insert the latching pin into the latching pin hole, a further preferred development of the invention provides for the end of the latching pin to be rounded and/or for the latching hole opening in the rear side of the housing for receiving the latching pin to be rounded. The engagement of the latching pin in the latching hole opening when the insulating housings are plugged on top of one another can thus be facilitated.

A further preferred development of the invention consists in the insulating housing, the latching pin, the latching hole, the latching hook and the catch being formed integrally. The insulating housing can thus be produced as a stable part with little outlay and in one operation.

In order to securely interconnect the insulating housings, a further preferred development of the invention finally provides for the insulating housing to comprise a plurality of latching pins and a plurality of latching holes and/or a plurality of latching hooks and a plurality of catches.

FIG. 1 is a three-dimensional view of an insulating housing 10 of an electrical terminal device, it being possible for a plurality of insulating housings 10 to be plugged on top of one another in order to form an electrical terminal block. In order to plug a plurality of insulating housings 10 on top of one another to form a terminal block, each insulating housing 10 comprises latching pins 14 that are arranged on the front side 12 of the housing and protrude therefrom in a direction perpendicular to the plane of the front side 12 of the housing, and latching hooks 16 that protrude from the front side 12 of the housing.

Figure 2:
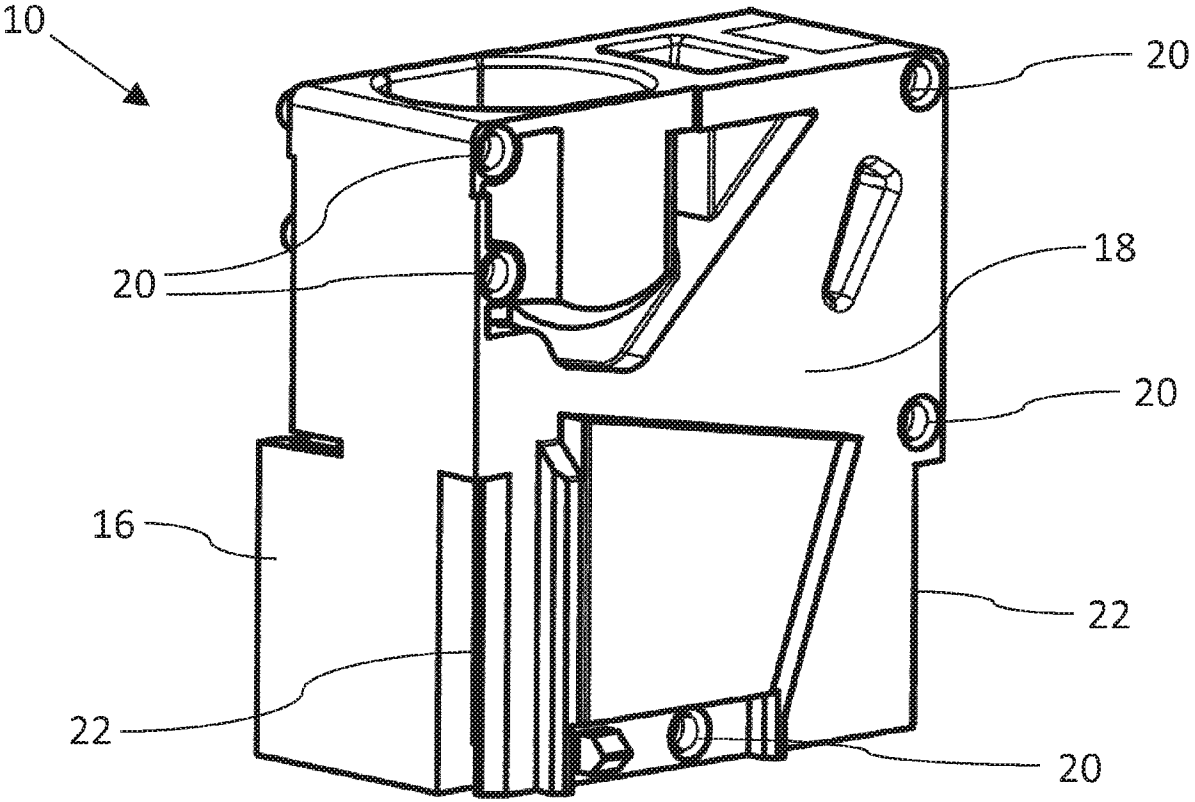
FIG. 2 is a three-dimensional view of the insulating housing from the rear side of the housing, according to the preferred embodiment of the invention.

As can be seen in FIG. 2, latching holes 20 are formed in the rear side 18 of the housing in a direction perpendicular to the plane of the rear side 18 of the housing. Catches 22 are additionally arranged on the rear side 18 of the housing.

Figure 3:
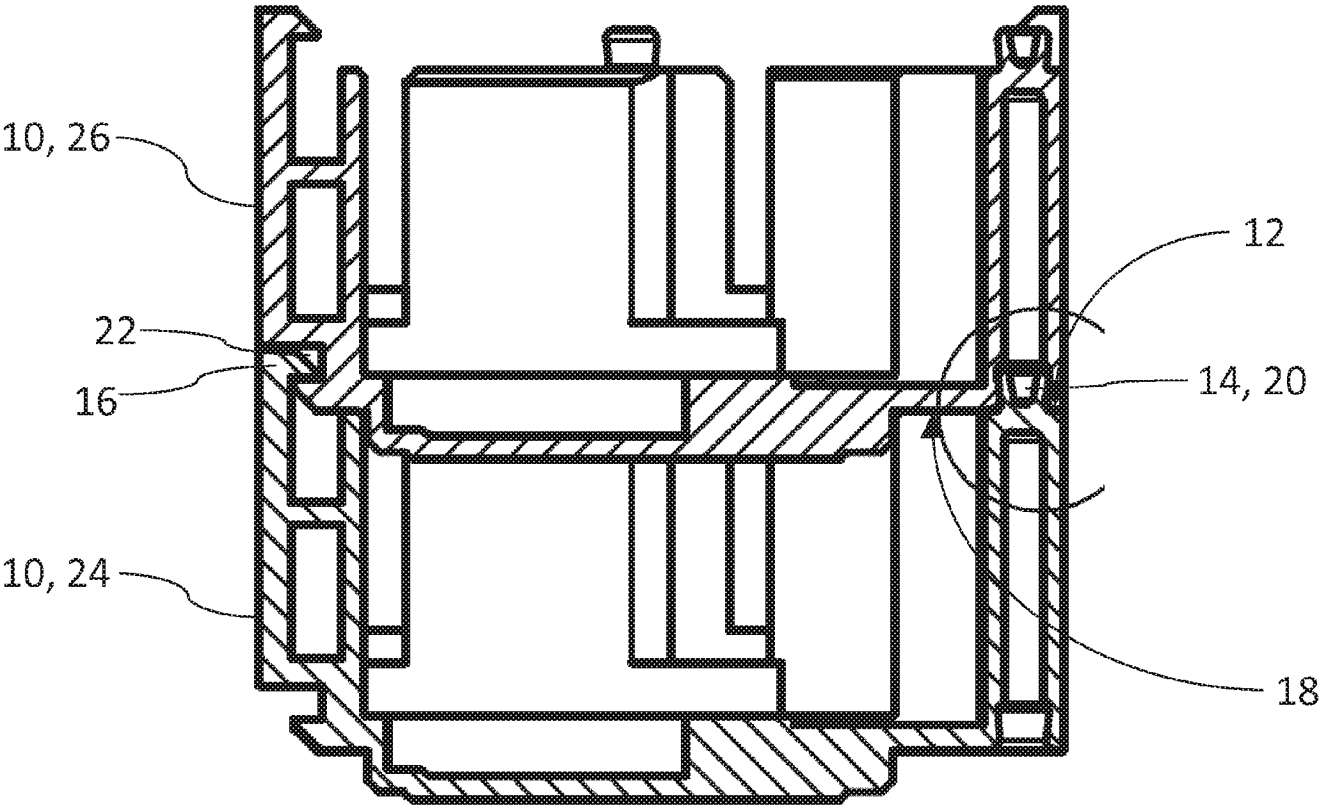
FIG. 3 shows insulating housings plugged on top of one another according to the preferred embodiment of the invention.

Insulating housings 10 that have been plugged on top of one another can be seen in FIG. 3. In order to connect the first insulating housing 24 to the second insulating housing 26, the latching pin 14 arranged on the front side 12 of the housing of the first insulating housing 24 engages in the latching hole 20 arranged on the rear side 18 of the housing of the second insulating housing 26. In addition, the latching hooks 16 arranged on the front side 12 of the housing of the first insulating housing 24 engage in the catches 22 arranged on the rear side 18 of the housing of the second insulating housing 26. The first insulating housing 24 and the second insulating housing 26 are thus interconnected.

Figure 4:
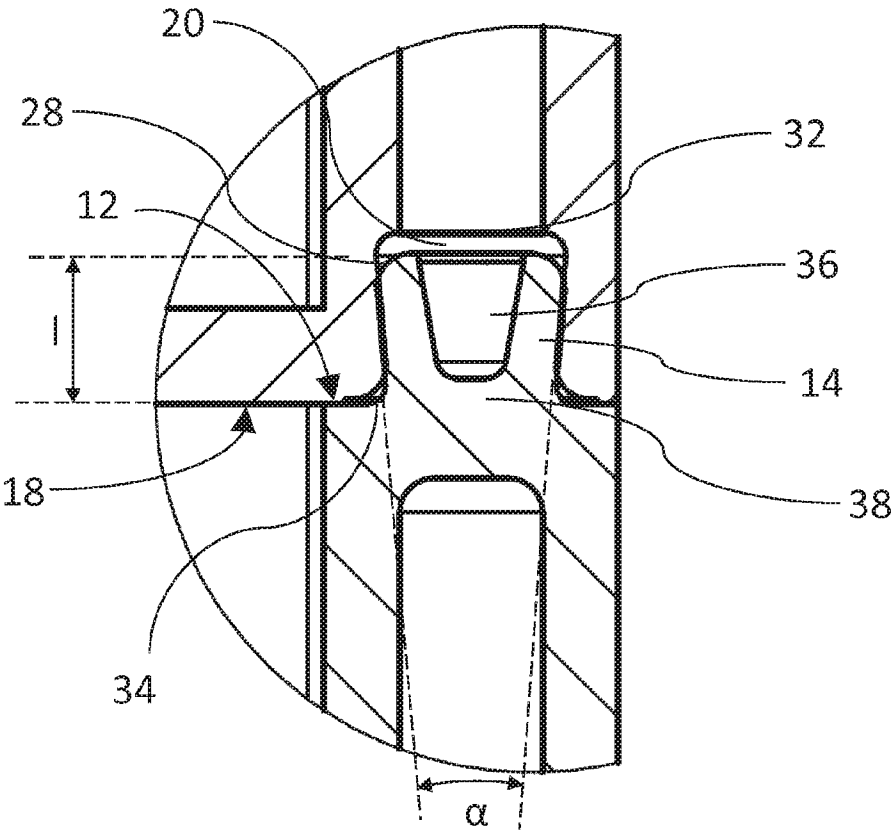
FIG. 4 is a detail of a latching pin and a latching hole according to the preferred embodiment of the invention.

It can be seen from FIG. 4 that the latching pin 14 and the latching hole 20 are formed in the shape of a truncated cone, the diameter of the latching pin 14 increasing from the front side 12 of the housing towards the end 28 of the latching pin, and the diameter of the latching hole 20 increasing from the rear side 18 of the housing towards the base 32 of the latching hole. Thus, when the insulating housings 10 plugged on top of one another are pulled apart, the truncated cone-shaped design of the latching pin 14 and of the latching hole 20 generates a restoring force in a direction perpendicular to the plane of the front side 12 of the housing and of the rear side 18 of the housing, respectively, which force pulls together the insulating housings 10 that are plugged on top of one another. A clearance-free fit of the insulating housings 10 plugged on top of one another can thus be achieved.

It can be seen, in addition, that the end 28 of the latching pin is rounded. The insertion of the truncated-cone shaped latching pin 14 into the latching hole opening 34 of the latching hole 20 is thus facilitated.

The latching pin 14 and the latching hole 20 have a cone angle $\alpha$ of approximately 10°. A cone angle of this kind is particularly suitable for low-deformation latching pins 14.

In order to facilitate the process of inserting the latching pin 14 into the latching hole opening 34, the latching pin 14 has a conical recess 36 at the end 28 of the latching pin, which recess is arranged in the axial direction of the latching pin 14. The latching pin 14 is thus provided with a wall, the end 28 of the latching pin being deformable in order to be inserted in the latching hole opening 34.

In order to increase the stability of the latching pin 14 while maintaining a certain degree of rigidity of the latching pin 14, the depth of the recess 36 is approximately 80% of the length of the latching pin 14. The latching pin 14 thus comprises a latching pin base 38 that makes the connection of the latching pin 14 to the front side 12 of the housing very stable.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

10 Insulating housing
12 Front side of the housing
14 Latching pin
16 Latching hook
18 Rear side of the housing
20 Latching hole
22 Catch
24 First insulating housing
26 Second insulating housing
28 End of the latching pin
32 Base of the latching hole
34 Latching hole opening
36 Recess
38 Latching pin base

The invention claimed is:

1. An insulating housing of an electrical terminal device, a plurality of the insulating housing being capable of being plugged on top of one another to form an electrical terminal block, the insulating housing comprising:

a latching pin arranged on a front side of the housing and that protrudes therefrom in a direction perpendicular to a plane of the front side of the housing, the latching pin configured to engage in a latching hole arranged on a rear side of the housing in a direction perpendicular to a plane of the rear side of the housing; and a latching hook that protrudes from the front side of the housing and is configured to engage in and latch behind a catch arranged on the rear side of the housing, wherein the latching pin and the latching hole have a shape of a truncated cone, a diameter of the latching pin increases from the front side of the housing towards an end of the latching pin, and a diameter of the latching hole increases from the rear side of the housing towards a base of the latching hole.

2. The insulating housing of an electrical terminal device according to claim 1, wherein a lateral surface of the latching pin rests against an entire surface of an inner surface of the latching hole when the plurality of the insulating housing are plugged on top of one another.

3. The insulating housing of an electrical terminal device according to claim 1, wherein the latching pin and the latching hole have a cone angle of between $1° \leq \alpha \leq 45°$.

4. The insulating housing of an electrical terminal device according to claim 1, wherein the latching pin comprises a recess at the end of the latching pin.

5. The insulating housing of an electrical terminal device according to claim 4, wherein the recess is conical in an axial direction of the latching pin.

6. The insulating housing of an electrical terminal device according to claim 4, wherein the recess has a depth in a longitudinal direction of the latching pin that corresponds to between $50\% \leq l \leq 100\%$ of a length of the latching pin.

7. The insulating housing of an electrical terminal device according to claim 1, wherein at least one of the end of the latching pin is rounded, or the latching hole opening in the rear side of the housing for receiving the latching pin is rounded.

8. The insulating housing of an electrical terminal device according to claim 1, wherein the insulating housing, the latching pin, the latching hole, the latching hook, and the catch are formed integrally.

9. The insulating housing of an electrical terminal device according to claim 1, wherein the insulating housing comprises at least one of a plurality of latching pins and a plurality of latching holes, or a plurality of latching hooks and a plurality of catches.

10. The insulating housing of an electrical terminal device according to claim 3, wherein the cone angle is between $1° \leq \alpha \leq 20°$.

11. The insulating housing of an electrical terminal device according to claim 6, wherein the recess has a depth in the longitudinal direction of the latching pin that corresponds to between $50\% \leq l \leq 80\%$ of the length of the latching pin.

* * * * *